US007544252B1

(12) United States Patent
Scea et al.

(10) Patent No.: US 7,544,252 B1
(45) Date of Patent: Jun. 9, 2009

(54) SPRING ACTUATED SLOTTED DIMM CONTACT CLEANING DEVICE

(75) Inventors: Kenneth A. Scea, Poughkeepsie, NY (US); Alex R. Jorge-Ortiz, Fishkill, NY (US); Paul Drake, Walkill, NY (US); John Chang, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/194,742

(22) Filed: Aug. 20, 2008

(51) Int. Cl.
*B08B 7/00* (2006.01)
*B08B 7/04* (2006.01)

(52) U.S. Cl. ..... 134/6; 134/9; 15/97.1

(58) Field of Classification Search ..... 134/6, 134/9, 26, 32, 42; 15/97.1, 101, 102, 103.5, 15/118, 209.1; 451/461, 523, 557; 369/72
See application file for complete search history.

(56) References Cited

U.S. PATENT DOCUMENTS

| | | | |
|---|---|---|---|
| 4,993,100 | A | 2/1991 | Halboth et al. |
| 5,177,906 | A | 1/1993 | Balding et al. |
| 5,179,808 | A | 1/1993 | Bakanowsky, III |
| 5,461,747 | A | 10/1995 | Clausen et al. |
| 5,525,417 | A | 6/1996 | Eyler |
| 6,777,966 | B1 | 8/2004 | Humphrey et al. |
| 6,836,922 | B2 | 1/2005 | Weng |
| 6,973,011 | B2 | 12/2005 | Murakami et al. |
| 7,077,315 | B2 | 7/2006 | McCance |
| 7,092,337 | B2 | 8/2006 | Butler et al. |
| 7,290,304 | B2 | 11/2007 | Muhr-Sweeney |
| 2003/0024061 | A1 | 2/2003 | Weng |
| 2005/0155045 | A1 | 7/2005 | Iwamura |
| 2007/0036057 | A1 | 2/2007 | Lee |

FOREIGN PATENT DOCUMENTS

| | | |
|---|---|---|
| JP | 2001-307040 | 11/2001 |
| JP | 2003-170987 | 6/2003 |
| JP | 2006-268791 | 10/2006 |

*Primary Examiner*—Alexander Markoff
(74) *Attorney, Agent, or Firm*—Saidman DesignLaw Group

(57) ABSTRACT

A method of cleaning a contact surface on an integrated circuit module using a slotted, complementary-dual-housing mechanical cleaning apparatus. The cleaning apparatus includes a spring-actuated device and a replaceable cleaning cloth.

1 Claim, 4 Drawing Sheets

SPRING ACTUATED SLOTTED DIMM CONTACT CLEANING DEVICE

BACKGROUND OF THE INVENTION

1. Field of the Invention

The present invention generally relates to a method for cleaning electrical contacts on a packaged integrated circuit module in order to prevent interference with performance and to prevent system failures. More specifically, the method includes providing a mechanical cleaning device having a spring-loaded pressure adjustment screw and a replaceable and movable cleaning strip for cleaning components such as a dual in-line memory module (DIMM) or other near chip scale or chip scale packages, that have enhanced reliability for high speed memory applications.

2. Description of the Related Art

In an integrated circuit (IC) chip manufacturing environment, there are commodities or parts which may be assembled on a cleanroom floor. Some of these commodities, for example, tabbed DIMMs and other parts having a gold tab interfaces, collect dirt and debris on a contact surface which subsequently interferes with performance of the part. This interference may result in poor performance and system failures. Examples of malfunctions on tabbed DIMMs are reseat issues, initial memory load (IML) customer engineer (CE) errors and other functional problems.

Analysis of troubleshooting results from these manufacturing parts shows significant amounts of contaminants on the contact surfaces, which implies that the part may have not undergone a cleaning process. One method of cleaning DIMMs is using isopropyl alcohol (IPA) with wipes or cloths, or employing solvents via swab-type methods, or employing hand-held cleaning, polishing or burnishing tools. However, these methods may be impractical in a manufacturing environment because they are awkward and the process may not easily be accomplished. In addition, alcohol-based solutions can detrimentally affect the life of the more sensitive, internal working components of these parts. For example, repeated cleaning with an alcohol-based solution can adversely affect the male contact surfaces. Moreover, bulk shipping of alcohol-based solutions can often be difficult and may require special permits and/or less than efficient shipping methods due to certain countries classifying alcohol-based solutions as hazardous or unsafe substances.

SUMMARY OF THE INVENTION

The present invention provides for a method for cleaning a contact surface of an electronic part such as an integrated circuit module. More specifically, the method includes providing a slotted, complementary-dual-housing mechanical cleaning apparatus which is simple to use and efficient in providing a clean contact surface for a DIMM without compromising the integrity of the internal working components of the electronic part. The apparatus is scalable/configurable to a variety of memory card widths.

One embodiment of the present invention includes a slotted, complementary-dual-housing mechanical spring-actuated cleaning apparatus, containing a moveable/replaceable cleaning cloth/strip that will wipe a contact surface clean. A memory card such as a tabbed DIMM card is inserted into a cleaning slot having tension adjustment capabilities and tabs of the DIMM card are wiped through the slot. Alternatively, the cleaning apparatus is used to wipe the tabs of the DIMM card.

A spring-loaded adjustment clamp on the cleaning apparatus applies an adequate wipe pressure for effective cleaning.

In another embodiment of the present invention, the cleaning apparatus further includes a magnetic closure for housing replacement cleaning strips to optimize maintenance time.

In another embodiment of the present invention, the cleaning apparatus further includes reservoirs thereon for adding a cleaning agent, lubricant or solvent to the electrical contacts on the integrated circuit module.

A method of cleaning electrical contacts on an integrated circuit module using a slotted, complementary-dual-housing mechanical cleaning apparatus comprising a spring-actuated tension adjustment mechanism, a wipe top holder/tension adjustment area, a tension/adjustable cleaning area, a wipe opening, a wiping cloth, a wipe lock, a plurality of cleaning head alignment pins, a plurality of cleaning head holes, a magnet, and a reservoir, the method comprising:

loading an integrated circuit module having a first surface and a second surface onto the slotted, complementary-dual-housing mechanical cleaning apparatus, the integrated circuit module having a first plurality of electrical contacts providing a first cleaning substrate disposed on the first surface and having a second plurality of electrical contacts providing a second cleaning substrate disposed on the second surface;

inserting the wipe cloth into the wipe opening along the tension/adjustable cleaning area such that it is secured in the wipe top holder/tension adjustment area, and filling the reservoir with a cleaning agent;

inserting the integrated circuit module into the tension/adjustable cleaning area such that the first plurality of electrical contacts are capable of contacting the wiping cloth by moving along a predetermined wiping path;

fastening the wipe lock and tightening the spring-actuated tension adjustment mechanism such that the magnet, the plurality of cleaning head alignment pins and the plurality of cleaning head alignment holes maintain the slotted, complementary-dual-housing mechanical cleaning apparatus in a pressure-coupled state;

contacting the first cleaning substrate with the wiping cloth;

moving the integrated circuit module through the predetermined wiping path such that at least one electrical contact on the first cleaning substrate is cleaned and decontaminated;

unfastening the wipe lock and loosening the spring-actuated tension adjustment mechanism such that the magnet, the plurality of cleaning head alignment pins and the plurality of cleaning head alignment holes no longer maintain the slotted, complementary-dual-housing mechanical cleaning apparatus in a pressure-coupled state;

removing the integrated circuit module from the tension/adjustable cleaning area;

reorienting and re-inserting the integrated circuit module into the tension/adjustable cleaning area such that the second surface is oriented so that the second plurality of electrical contacts are capable of contacting the wiping cloth by moving along a predetermined wiping path;

fastening the wipe lock and tightening the spring-actuated tension adjustment mechanism such that the magnet, the plurality of cleaning head alignment pins and the plurality of cleaning head alignment holes maintain the slotted, complementary-dual-housing mechanical cleaning apparatus in a pressure-coupled state;

contacting the second cleaning substrate with the wiping cloth;

moving the integrated circuit module through the predetermined wiping path such that at least one electrical contact on the second cleaning substrate is cleaned and decontaminated;

unfastening the wipe lock and loosening the spring-actuated tension adjustment mechanism such that the magnet, the plurality of cleaning head alignment pins and the plurality of cleaning head alignment holes no longer maintain the slotted, complementary-dual-housing mechanical cleaning apparatus in a pressure-coupled state; and removing the integrated circuit module from the tension/adjustable cleaning area.

Furthermore, embodiments of the present invention can be directed to a system and associated apparatuses which are automated instead of manual where servers and processors are used. In addition, embodiments of the present invention can also be implemented as a program causing a computer to execute the above-described method. The program can be distributed via a computer-readable storage medium such as a CD-ROM.

DETAILED DESCRIPTION OF EMBODIMENTS OF THE INVENTION

Figure 1:
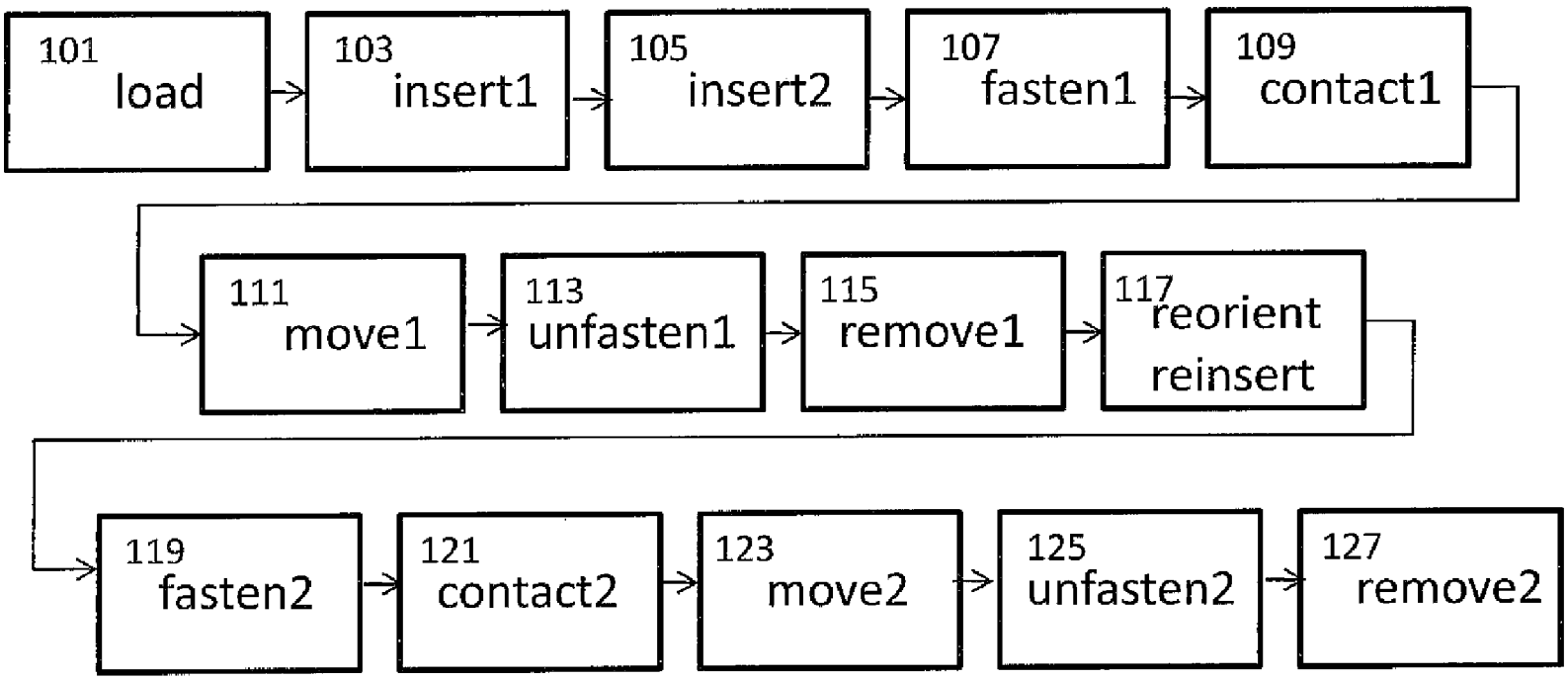
FIG. 1 is a flowchart of a method according to an embodiment of the invention.

In the description that follows, numerous details are set forth in order to provide a thorough understanding of the present invention. It will be appreciated by those skilled in the art that variations of these specific details are possible while still achieving the results of the present invention. Well-known elements and processing steps are generally not described in detail in order to avoid unnecessarily obscuring the description of the present invention.

In the drawings accompanying the description that follows, often both reference numerals and legends (labels, text descriptions) may be used to identify elements. If legends are provided, they are intended merely as an aid to the reader, and should not in any way be interpreted as limiting.

Referring to Figures, the method of cleaning electrical contacts on an integrated circuit module using a slotted, complementary-dual-housing mechanical cleaning apparatus is shown in the flowchart in FIG. 1.

Figure 2:
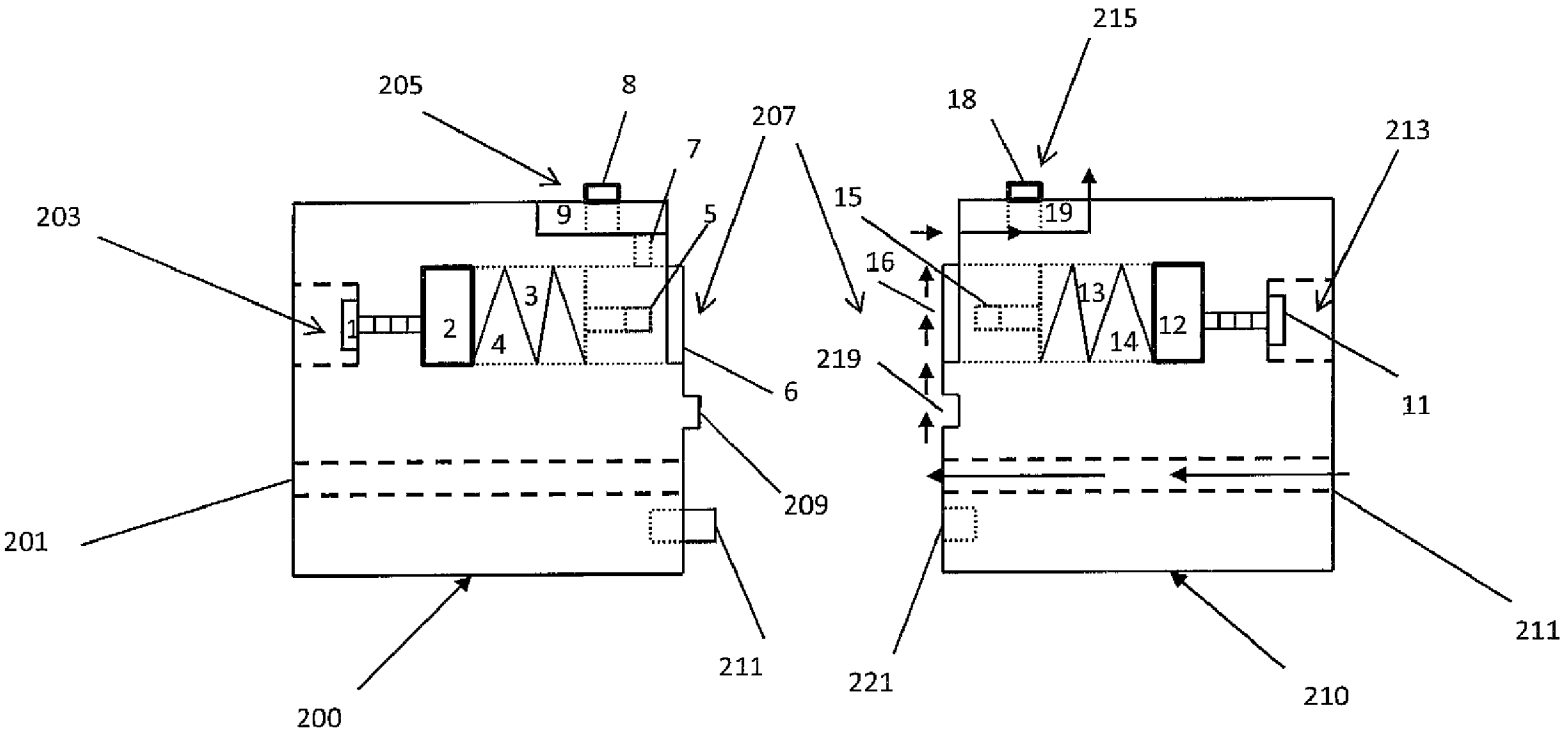
FIG. 2 is a detailed view of a slotted, complementary-dual-housing mechanical cleaning apparatus according to another embodiment of the invention.
Figure 3:
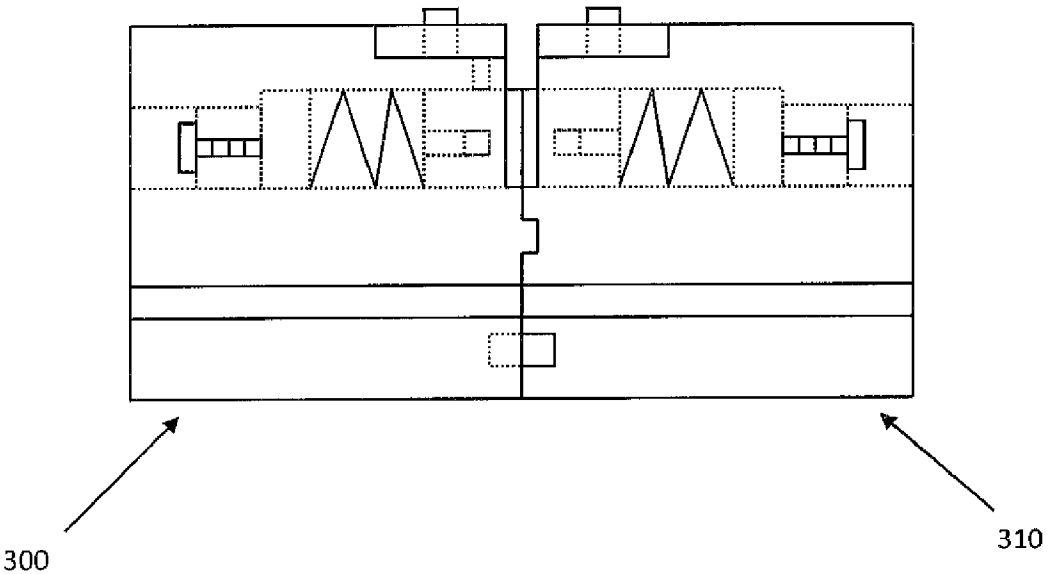
FIG. 3 is an assembled view of the apparatus according to FIG. 2.
Figure 4:
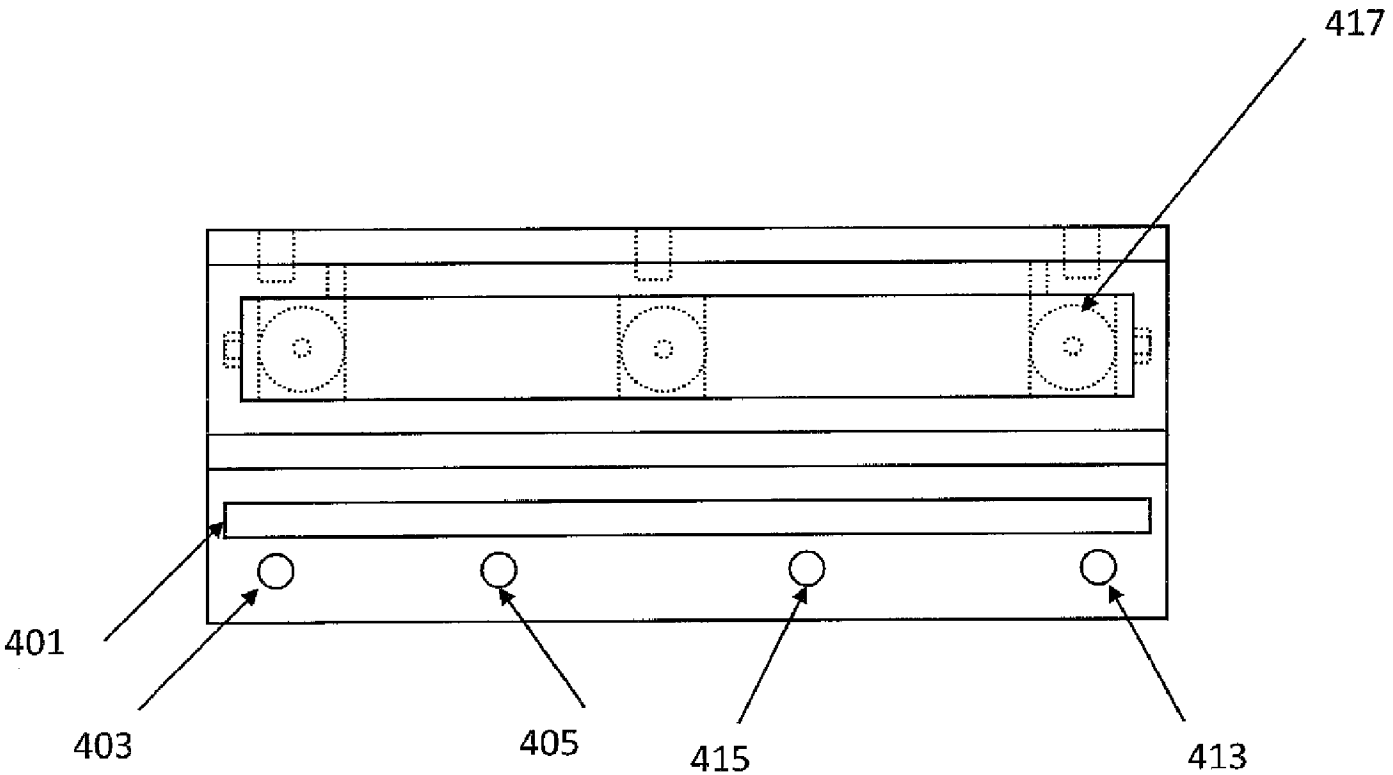
FIG. 4 is an assembled side view of the apparatus according to FIG. 2.

In step 101 an integrated circuit module (not shown) is loaded onto a slotted, complementary-dual-housing mechanical cleaning apparatus 200/210 (FIG. 2, detailed view), 300/310 (FIG. 3, assembled view) and side view shown in FIG. 4. Next, in step 103 a wipe cloth (not shown) is inserted into a wipe opening/slot 201/211/401 along a tension/adjustable cleaning area 207 and secured in a wipe top holder/tension adjustment area 205/215 and a cleaning agent (not shown) is placed in the reservoir 7. The wipe top holder/tension adjustment area 205/215 includes a holding screw 8/18 and a wipe holder 9/19. However, the order of steps 101 and 103 are interchangeable.

In step 105, the integrated circuit module is inserted into the tension/adjustable cleaning area 207 so a first plurality of electrical contacts (not shown) can be contacted by the wiping cloth (not shown) by moving the integrated circuit module along a predetermined wiping path. Next, in step 107, the wipe lock 209/219 is fastened with holding screw 8/18 and a spring-actuated tension adjustment mechanism 203/213 is tightened with set screw 1/11 so that a magnet 403/413, a plurality of cleaning head alignment pins 211/405/415 and a plurality of cleaning head alignment holes 221 maintain the slotted, complementary-dual-housing mechanical cleaning apparatus 200/210 in a pressure-coupled state. The tension adjustment mechanism 203/213 also includes a metal flat 2/12, a spring 3/13, a spring housing 4/14 a cleaning bar detent 5/15, a cleaning bar 6/16 and a cleaning agent reservoir/port 7/17. The magnet 403/413 also provides a housing for enclosing replacement cleaning cloths.

In step 109, a first cleaning substrate of the integrated circuit module (not shown) is contacted with the wiping cloth (not shown) and moved through the predetermined wiping path so at least one electrical contact on the first cleaning substrate is cleaned and decontaminated in step 111.

In step 113, the wipe lock 209/219 is unfastened and the spring-actuated tension adjustment mechanism 203/213 is loosened such that the magnet 413, the plurality of cleaning head alignment pins 211/405/415 and the plurality of cleaning head alignment holes 221 no longer maintain the slotted, complementary-dual-housing mechanical cleaning apparatus 200/210 in a pressure-coupled state.

Next, the integrated circuit module is removed from the tension/adjustable cleaning area 207 in step 115. In order to clean the other substrate, the integrated circuit module is reoriented and re-inserted the into the tension/adjustable cleaning area 207 in step 117 such that the second surface is oriented so that a second plurality of electrical contacts can contact the wiping cloth by moving along a predetermined wiping path.

In step 119, the wipe lock (not shown) is fastened and the spring-actuated tension adjustment mechanism is tightened such that the magnet 413, the plurality of cleaning head alignment pins 211/405/415 and the plurality of cleaning head alignment holes 221 maintain the slotted, complementary-dual-housing mechanical cleaning apparatus 200/210/300/310 in a pressure-coupled state.

Next, in step 121 the second cleaning substrate is contacted with the wiping cloth and moved through the predetermined wiping path such that at least one electrical contact on the second cleaning substrate is cleaned and decontaminated.

In step 123, the wipe lock 209/219 is unfastened and the spring-actuated tension adjustment mechanism 203/213 is loosened such that the magnet 413, the plurality of cleaning head alignment pins 211/405/415 and the plurality of cleaning head alignment holes 221 no longer maintain the slotted, complementary-dual-housing mechanical cleaning apparatus 200/210, 300/310 in a pressure-coupled state. Then, in step 125, the integrated circuit module is removed from the tension/adjustable cleaning area 207.

Although three (3) cleaning head alignment pins/holes are shown, the number may be different depending on the size or type of commodity being cleaned which comes within the purview of the present invention and, a determining of the amount of pressure required to adequately remove the contaminants.

One portion 200/300 and other portion 210/310 are releasably attached by cleaning head alignment pins 211/405/415, cleaning head holes 221, and magnet 413. The slotted, complementary-dual-housing mechanical cleaning apparatus 200/210/300/310 accommodates a variety of contact/connector sizes using the tension adjustment mechanism 203/213.

The wipe cloth (not shown) is releasably attached to the wipe top holder/tension adjustment 205/215 using holding screw 8/18 and wipe lock 209/219. The wiping cloths (not shown) may be composed of any suitable mildly abrasive cloth. Also, the cloth selected is able to absorb a liquid or a contact cleaner material, if desired, and to effectively clean the tabs, leads, pins, terminals, magnetic strips, and the like, of a piece of electronic material. However, the cleaning material is not abrasive and, use of liquid cleaner is not required. The replaceable and movable cleaning cloth may be made from any anti-static and dry material. Cleaning agents are added on the contact surface, but not integrated into the cloth.

In operation, a commodity, such as a tabbed DIMM (not shown) is inserted into the tension/adjustable cleaning area 207. The tabbed DIMM is moved along a predetermined wiping path such that the tabs make contact with the wiping cloth to clean and decontaminate the tabs. When, after use, the wiping cloth (not shown) has deteriorated, or itself has become contaminated with dust, dirt, oil and other debris, another wiping cloth may be inserted into wipe opening/slot 201/211/401. Alternatively, the cleaning device may be moved along a predetermined wiping path rather than moving the electronic part to effect cleaning.

It is not beyond the scope of the present disclosure to manufacture the slotted, complementary-dual-housing mechanical cleaning apparatus 200/210, 300/310 in other known shapes or to use the cleaning apparatus to clean other electronic equipment using the spring-loaded pressure adjustment screw 1/11. As can be appreciated and by way of example, the cleaning apparatus can be shaped to clean memory modules, data cards, smart cards, and the like due to the controlled elasticity and pressure of the tension adjustment mechanism 203/213.

While contact tabs have been discussed, other clean board electrical contacts may be used such as a DIMM socket, DIMM slot, a memory or PCI card, and other sockets, slots or card or parts with outwardly exposed connecting tabs or electrical contacts. Such alternatives will be apparent to those of ordinary skill in the art.

While an embodiment of the invention has been described in terms of disclosed embodiments, those skilled in the art will recognize that the invention can be practiced with modification within the spirit and scope of the appended claims.

What is claimed is:

1. A method of cleaning electrical contacts on an integrated circuit module using a slotted, complementary-dual-housing mechanical cleaning apparatus comprising a spring-actuated tension adjustment mechanism, a wipe top holder/tension adjustment area, a tension/adjustable cleaning area, a wipe opening, a wiping cloth, a wipe lock, a plurality of cleaning head alignment pins, a plurality of cleaning head holes, a magnet, and a reservoir, the method comprising:

loading an integrated circuit module having a first surface and a second surface onto the slotted, complementary-dual-housing mechanical cleaning apparatus, the integrated circuit module having a first plurality of electrical contacts providing a first cleaning substrate disposed on the first surface and having a second plurality of electrical contacts providing a second cleaning substrate disposed on the second surface;

inserting the wipe cloth into the wipe opening along the tension/adjustable cleaning area such that it is secured in the wipe top holder/tension adjustment area and filling the reservoir with a cleaning agent;

inserting the integrated circuit module into the tension/adjustable cleaning area such that the first plurality of electrical contacts are capable of contacting the wiping cloth by moving along a predetermined wiping path;

fastening the wipe lock and tightening the spring-actuated tension adjustment mechanism such that the magnet, the plurality of cleaning head alignment pins and the plurality of cleaning head alignment holes maintain the slotted, complementary-dual-housing mechanical cleaning apparatus in a pressure-coupled state;

contacting the first cleaning substrate with the wiping cloth;

moving the integrated circuit module through the predetermined wiping path such that at least one electrical contact on the first cleaning substrate is cleaned and decontaminated;

unfastening the wipe lock and loosening the spring-actuated tension adjustment mechanism such that the magnet, the plurality of cleaning head alignment pins and the plurality of cleaning head alignment holes no longer maintain the slotted, complementary-dual-housing mechanical cleaning apparatus in a pressure-coupled state;

removing the integrated circuit module from the tension/adjustable cleaning area;

reorienting and re-inserting the integrated circuit module into the tension/adjustable cleaning area such that the second surface is oriented so that the second plurality of electrical contacts are capable of contacting the wiping cloth by moving along a predetermined wiping path;

fastening the wipe lock and tightening the spring-actuated tension adjustment mechanism such that the magnet, the plurality of cleaning head alignment pins and the plurality of cleaning head alignment holes maintain the slotted, complementary-dual-housing mechanical cleaning apparatus in a pressure-coupled state;

contacting the second cleaning substrate with the wiping cloth;

moving the integrated circuit module through the predetermined wiping path such that at least one electrical contact on the second cleaning substrate is cleaned and decontaminated;

unfastening the wipe lock and loosening the spring-actuated tension adjustment mechanism such that the magnet, the plurality of cleaning head alignment pins and the plurality of cleaning head alignment holes no longer maintains the slotted, complementary-dual-housing mechanical cleaning apparatus in a pressure-coupled state; and removing the integrated circuit module from the tension/adjustable cleaning area.

* * * * *